US005788059A

United States Patent [19]

Jahangiri

[11] Patent Number: 5,788,059

[45] Date of Patent: Aug. 4, 1998

[54] ELECTRICAL SWITCH COVER AND COVER-SWITCH ASSEMBLY

[76] Inventor: Farhad Fred Jahangiri, 416 Fresh Meadows Rd., Simi Valley, Calif. 93065

[21] Appl. No.: 682,977

[22] Filed: Jul. 16, 1996

[51] Int. Cl.[6] ..... H01H 21/08

[52] U.S. Cl. ..... 200/302.3

[58] Field of Search ..... 200/302.3

[56] References Cited

U.S. PATENT DOCUMENTS

| | | | |
|---|---|---|---|
| 2,334,901 | 11/1943 | Bullerjahn | 200/302.3 X |
| 2,795,144 | 6/1957 | Morse | 200/302.3 X |
| 3,028,467 | 4/1962 | Hubbell | 200/302.3 |
| 3,236,990 | 2/1966 | Bates | 200/302.3 |
| 3,928,742 | 12/1975 | Rule | 200/302.3 |
| 5,380,968 | 1/1995 | Morse | 200/302.3 |

*Primary Examiner*—Renee S. Luebke
*Attorney, Agent, or Firm*—John J. Posta, Jr.

[57] ABSTRACT

The protective electrical switch cover is in the form of a generally flat, flexible, resilient plate of extended surface area and with memory. Preferably, the cover is of elastomeric electrically insulative plastic and/or rubber and is unitary. It includes a generally central, hollow, protruding nipple adapted to receive the arm of an electrical switch over which the cover is to be mounted, as by an adhesive layer on the rear surface of the cover. The nipple is surrounded by a number of spaced encircling folds or rings which permit the nipple to be readily flexed in a plurality of directions in order to operate the switch arm. Thus, through the nipple, the switch arm can be rotated or flipped in a desired direction and can be pushed in and pulled out, depending on the type of switch arm involved. Moreover, the encircling folds can be depressed at a desired location to operate the switch arm if it is of the rocker type. The assembly of the present invention includes the cover mounted over an electrical switch having the protruding switch arm. The mounting area is outside of the area of the nipple and rings.

5 Claims, 2 Drawing Sheets

ELECTRICAL SWITCH COVER AND COVER-SWITCH ASSEMBLY

BACKGROUND OF THE INVENTION

1. Field of the Invention

The present invention generally relates to protective devices and more particularly to electrically insulative switch covers and assemblies of such switch covers with electrical switches.

2. Prior Art

Various types of covers have been provided in the past to protect electrical switches before and/or during use. For example, many types of electrical switches are housed in openable boxes. This includes external boxes which protect circuit breaker switches from moisture.

Most electrical switches, however, which are used to operate lights and appliances in the home and elsewhere do not have protective covers. Electrical switches located in certain areas such as the bathroom, kitchen and utility room of a home are subject to corrosion from moisture emanating from running water from faucets, bathtubs, sinks, toilet bowls and the like. Moreover, the likelihood that the user of the switch in such locations may have moist hands and be subject to electrical shock through the switch is considerable.

Accordingly, there is a need for a simple, inexpensive, attractive and efficient protective electrical switch cover. Most protective switch covers currently available are specifically designed to be usable only with one of a number of types of electrical switches. Thus, covers for push-pull types of switches are not useful with flip-type toggle switches and the like. There therefore is a need for an improved type of protective switch cover which need not be opened in order to be used, which effectively protects the switch from moisture and dirt and which is equally useful with push-pull types of switches as well as toggle and rocker arm types of switches.

SUMMARY OF THE INVENTION

The improved electrically insulative switch cover of the present invention satisfies all the foregoing needs. The cover and switch form a unique and improved assembly. The cover and assembly are substantially as set forth in the ABSTRACT OF THE DISCLOSURE.

Thus, the cover comprises a unitary, flexible, resilient plate with memory and may be formed in a single molding operation or the like from elastomeric rubber and/or plastic. The plate is of extended surface area and includes a generally central protruding hollow nipple adapted to receive the protruding arm of a switch over which the plate is mounted, as by an adhesive layer on the back of the perimeter of the plate.

The nipple is surrounded by a spaced plurality of folds or rings which are as flexible as the nipple. The rings enable the nipple to be flexed in any desired direction to operate the arm of an electrical switch housed therein. Thus, the nipple can be rotated, flipped to one side or another and can be pushed in and pulled out to operate a push-pull switch. Moreover, the rings can be depressed in any selected area to operate the rocker arm of a switch concealed by the cover. In the latter instance, the rocker arm underlies the rings and nipple but need not extend into the nipple.

As indicated above, the present invention includes the novel combination of the cover affixed to the switch. It will be noted that the cover fully overlies and protects the switch.

Moreover, the cover is not opened in order to operate the switch. Therefore, the cover affords fully electrically insulative protection of the user from an electrical shock from the switch, as when a user operates the switch with moisture on his or her hands.

Various other features of the improved cover and assembly of the present invention are set forth in the following detailed description and accompanying drawings.

DRAWINGS

Figure 6:
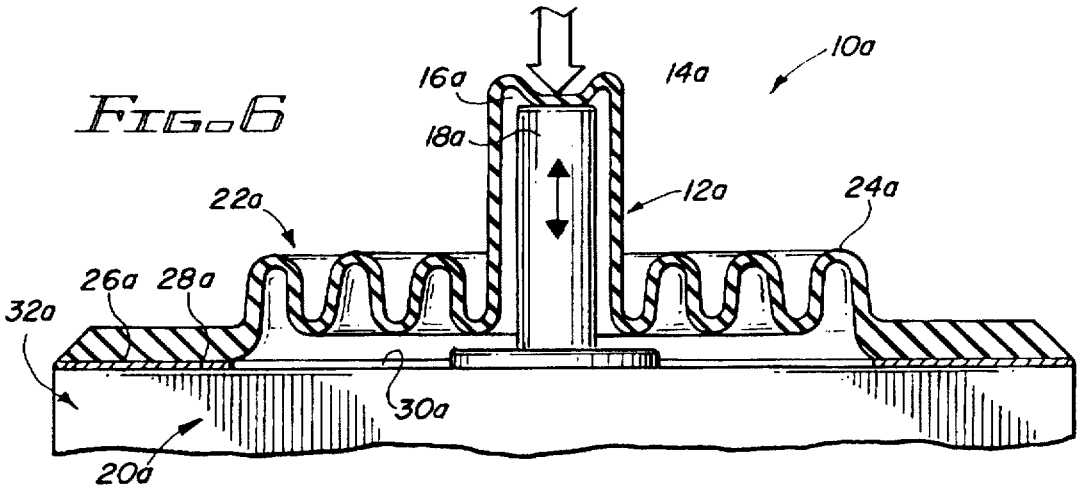
FIG. 6 is a greatly enlarged schematic cross-section of a second preferred embodiment of the assembly of the present invention, showing the arm of a push-pull switch in the pushed position.
Figure 7:
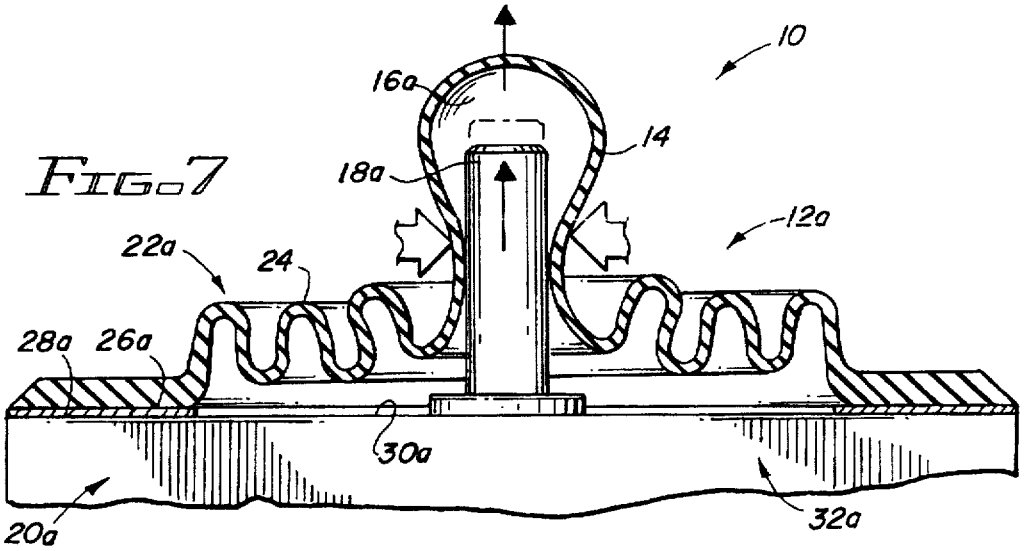
Figure 8:
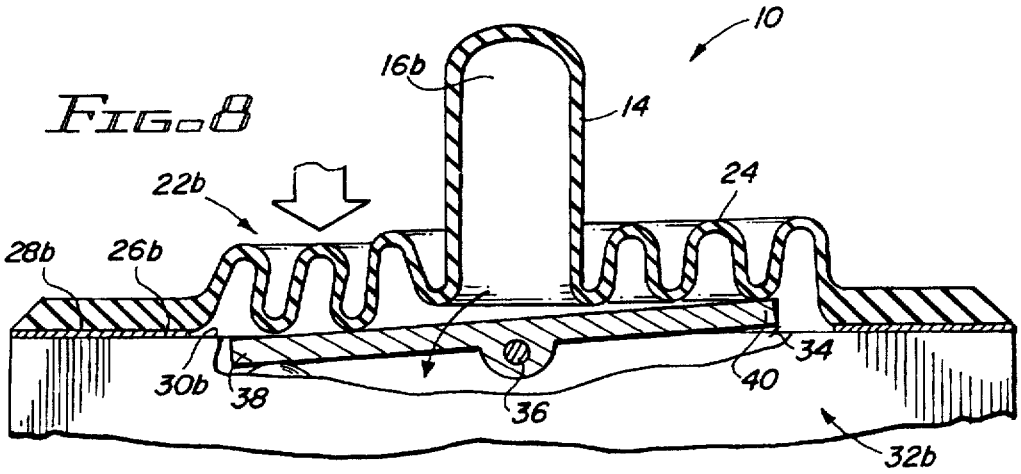

FIG. 7 is a greatly enlarged schematic cross-section of the assembly of FIG. 6, showing the nipple of the assembly pinched around the switch arm preparatory to lifting the switch arm by the nipple; and, FIG. 8 is a greatly enlarged schematic cross-section of a third preferred embodiment of the assembly of the present invention, showing a rocker-type switch arm urgeable into a desired position by pressing down on a selected portion of the rings of the cover.

DETAILED DESCRIPTION

Figure 1:
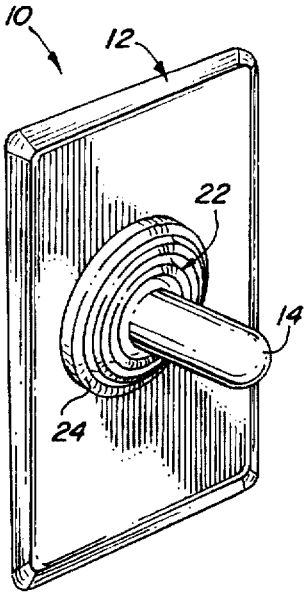
FIG. 1 is a schematic front perspective view of a preferred embodiment of the improved electrically insulative switch cover of the present invention.
Figure 2:
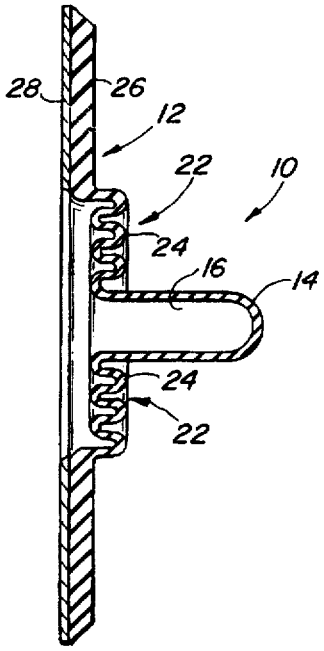
FIG. 2 is a schematic enlarged cross-section of the switch cover of FIG. 1.
Figure 3:
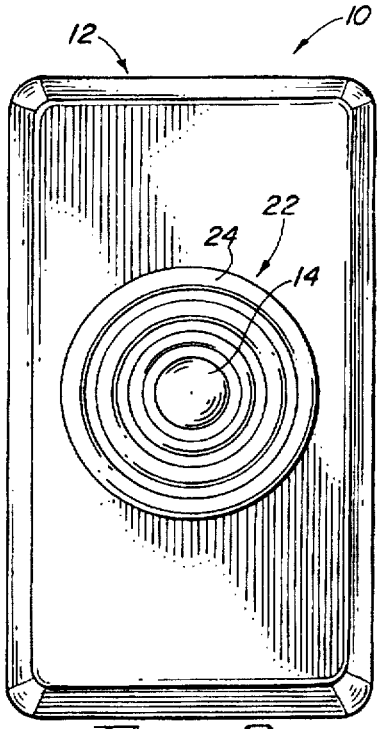
FIG. 3 is a schematic front elevation of the switch cover of FIG. 1.
Figure 4:
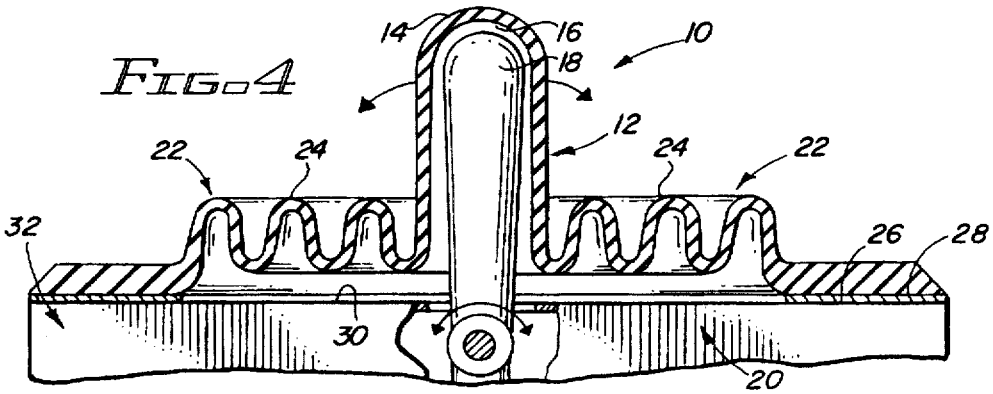
FIG. 4 is a greatly enlarged schematic cross-section of the switch cover of FIG. 1 in combination with a flip-type switch forming a first preferred embodiment of the assembly of the present invention, showing the switch arm in the "off" position.
Figure 5:
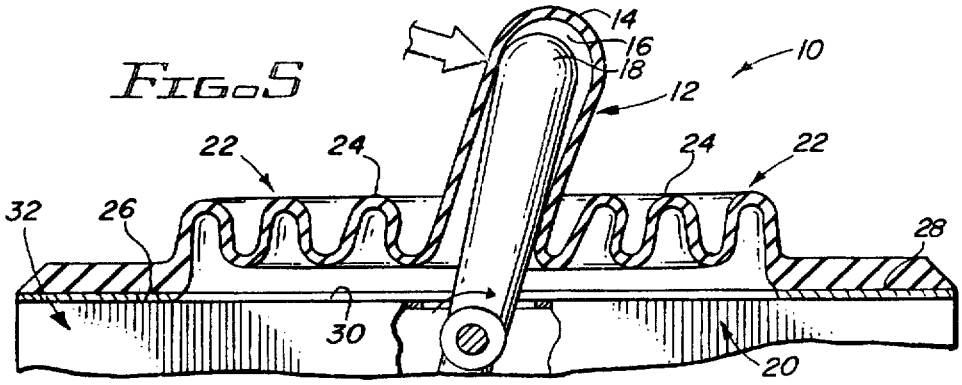
FIG. 5 is a greatly enlarged schematic cross-section of the assembly of FIG. 4, showing the switch arm in the flipped-over "on" position.

Now referring more particularly to FIGS. 1–5 of the drawings, a preferred embodiment of the improved electrically insulative switch cover of the present invention is schematically depicted therein. In FIGS. 4 and 5, the cover is shown in combination with a flip-type or toggle switch to form a first preferred embodiment of the improved assembly of the present invention. Thus, improved switch cover 10 is shown which comprises a generally flat plate 12 of extended surface area. Plate 12 may be of any suitable size and shape, for example, generally rectangular as shown in FIGS. 1 and 3. Plate 12 is formed of an elastomeric material, such as elastomeric rubber or plastic or a combination thereof and may, if desired, be fabricated as a unitary body in a single molding operation. Plate 12 has memory and is flexible and resilient as well as electrically insulative. It contains no openings through which an electrical shock could be transmitted. It is compact, attractive and durable.

Plate 12 defines a protruding generally central nipple 14 which has a central space 16 adapted to receive the protruding lever arm 18 of a flip-flop or toggle-type switch 20 (FIGS. 4 and 5). Nipple 14 is surrounded by a plurality of encircling spaced folds 22 which protrude from the main plane of plate 12 in the same direction as nipple 14. Preferably, folds 22 comprise spaced concentric raised rings 24. Rings 24 permit nipple 14 to be pulled up, pushed down and moved easily from side to side, as desired. The elastic memory of rings 24 causes nipple 14 to return, after flexing, to the original resting position shown in FIGS. 1–4.

Cover 10 can be made in suitable size and shape, for example, generally rectangular, with a plate 12 wall thickness of about 0.1 inch peripheral of rings 24 and nipple 14 and with nipple 14 and rings 24 having an average wall thickness of about 0.04 inch. Nipple 14 may be, for example, about 0.25 inch in diameter and about 0.5 inch in height and plate 12 may be, for example, about 1.5 inches by about 1 inch or any other suitable configuration and size.

The rear face 26 of plate 12 is secured by suitable anchoring means, such as an adhesive layer 28, to the exposed face 30 of switch 20, with nipple 14 enclosing lever arm 18, as shown in FIGS. 4 and 5, in order to form the improved electrically insulative protective switch assembly 32 of the present invention comprising cover 10 and switch 20 joined together.

As indicated in FIGS. 4 and 5, lever arm 18 can be easily and safely moved from the "neutral" or "off" position shown in FIG. 4 to the "on" position of FIG. 5 by urging nipple 14 and the enclosed lever arm 18 in the proper direction while fully electrically insulatively protecting the switch user. Accordingly, cover 10 and assembly 32 have improved properties in contrast to conventional switch covers and switch and cover assemblies.

FIGS. 6 and 7:

A second preferred embodiment of the improved assembly of the present invention is schematically depicted in FIGS. 6 and 7. Thus, assembly **32*a* is shown. Components thereof similar to those of assembly 32** bear the same numerals but are succeeded by the letter "a".

Assembly **32*a* is substantially identical to assembly 32**, except as follows:

a) Switch **20*a* is of the push-pull type, FIG. 6** showing lever arm *18* being depressed to the "switch on" position by depressing the top of nipple 14 in the direction of the nipple arrow;

b) FIG. 7 shows the sides of nipple 14 being pinched together before lifting arm **18*a* into the "switch-off" position indicated by the dotted outline, as by pulling up on nipple 14 in the direction of the in-line arrow. During such pulling, rings 24 flex up to easily permit nipple 14** to be pulled up.

Assembly **32*a* has the other advantages of assembly 32**.

FIG. 8:

A third preferred embodiment of the improved assembly of the present invention is schematically depicted in FIG. 8. Thus, assembly **32*b* is shown. Components thereof similar to those of assembly 32 or 32*a*** bear the same numerals but are succeeded by the letter "b".

Assembly **32*b* is substantially identical to assembly 32**, except as follows:

Switch **20*b* is of the rocker type, having a long switch lever arm 18*b* extending in a recess 34 in the exposed face 30*b* of switch 20*b* and generally parallel to the main plane of switch 20*b*. Arm 18*b* is mounted on a fulcrum or pivot point 36 with the opposite ends 38 and 40 of arm 18*b* positioned directly adjacent to rings 24 on opposite sides of nipple 14. With this arrangement, arm 18*b* can be rocked into and out of the "switch-on" position, merely by pressing down in the direction of the arrows on the appropriate portions of rings 24**.

Accordingly, cover 10 can be used successfully to cover and protect and operate a rocker-type switch, such as is commonly used in the walls of modern homes, without having to modify the shape, size or construction of cover 10.

In view of the above, it will be seen that the improved protective cover of the present invention is equally suitable for use with toggle-type switches, push-pull type switches and rocker arm-type switches and forms unique assemblies therewith, which assemblies have improved characteristics over the known prior art.

Various other modifications, changes, alterations and additions can be made in the improved protective cover and cover-switch assembly of the present invention, and in their components and parameters. All such modifications, changes, alterations and additions as are within the scope of the appended claims form part of the present invention.

What is claimed is:

1. A protective electrical switch and switch cover assembly, said assembly comprising, in combination:

a) an electrical switch having a protruding switch arm for operation of said switch; and, b) a protective cover mounted over said switch, said cover comprising a generally flat, electrically insulative, resilient, flexible unitary plate of extended surface area, said cover including means mounting said cover over said switch, said plate defining a generally central hollow nipple surrounded by a plurality of encircling folds and protruding from said plate, said folds permitting said nipple to be flexed in a plurality of directions, said cover permitting manipulation of said switch arm for operation of said switch, c) wherein said switch arm is a rocker switch arm and wherein said switch arm is urge able into a rocked position by pushing on a selected area of said folds.

2. The cover of claim 1 wherein said cover comprises an elastomer with memory.

3. The cover of claim 1 wherein said folds comprise concentric rings around said nipple.

4. The cover of claim 3 wherein said plate includes adhesive means for releasable connection of said plate over the electrical switch.

5. The cover of claim 4 wherein said rings are depressible for operating the arm of the switch when said plate is disposed over said arm.

* * * * *